US011138942B2

(12) United States Patent
Kang

(10) Patent No.: US 11,138,942 B2
(45) Date of Patent: Oct. 5, 2021

(54) DRIVING METHOD OF DISPLAY MODULE, DRIVING SYSTEM THEREOF, AND DRIVING DEVICE

(71) Applicant: HKC CORPORATION LIMITED, Shenzhen (CN)

(72) Inventor: Chih Tsung Kang, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/040,974

(22) PCT Filed: Mar. 11, 2019

(86) PCT No.: PCT/CN2019/077600
§ 371 (c)(1),
(2) Date: Sep. 23, 2020

(87) PCT Pub. No.: WO2020/118923
PCT Pub. Date: Jun. 18, 2020

(65) Prior Publication Data

US 2021/0090511 A1 Mar. 25, 2021

(30) Foreign Application Priority Data

Dec. 11, 2018 (CN) ..... 201811510600.7
Dec. 11, 2018 (CN) ..... 201811511896.4

(51) Int. Cl.
*G09G 3/34* (2006.01)
*G09G 3/36* (2006.01)
*G09G 5/06* (2006.01)

(52) U.S. Cl.
CPC ..... *G09G 3/3413* (2013.01); *G09G 3/342* (2013.01); *G09G 3/3607* (2013.01); *G09G 5/06* (2013.01);

(Continued)

(58) Field of Classification Search
CPC ..... G09G 3/34–3426; G09G 3/2003
See application file for complete search history.

(56) References Cited

U.S. PATENT DOCUMENTS

2009/0009539 A1 1/2009 Ahn et al.
2016/0117975 A1* 4/2016 Kang ..... G09G 3/2074 345/694

(Continued)

FOREIGN PATENT DOCUMENTS

CN 108010492 A 5/2018
CN 108231017 A 6/2018
KR 20010045098 A 6/2001

OTHER PUBLICATIONS

Yingying Nie, the International Searching Authority written comments, Sep. 2019, CN.

(Continued)

*Primary Examiner* — Roy P Rabindranath

(57) ABSTRACT

The present disclosure provides a driving method of a display module, a driving system thereof, and a display device. The driving method of the display module includes a display panel driving process, and a backlight module driving process driven synchronously with the display panel driving process. The display panel driving process includes steps: performing a color saturation adjustment; and obtaining second color signals to drive the display panel. The backlight module driving process includes steps: obtaining a first light source adjustment coefficient and a second light source adjustment coefficient; obtaining a second brightness value and a third brightness value; and driving the primary hue light source and the secondary by the second brightness value and the third brightness value respectively.

18 Claims, 5 Drawing Sheets

(52) U.S. Cl.
CPC . *G09G 2320/0666* (2013.01); *G09G 2340/06* (2013.01); *G09G 2360/16* (2013.01)

(56) References Cited

U.S. PATENT DOCUMENTS

| | | | | |
|---|---|---|---|---|
| 2017/0169751 | A1* | 6/2017 | Ando | G09G 5/02 |
| 2019/0228720 | A1* | 7/2019 | He | G09G 3/36 |

OTHER PUBLICATIONS

Yingying Nie, the International Search Report, dated Sep. 2019, CN.

* cited by examiner

DRIVING METHOD OF DISPLAY MODULE, DRIVING SYSTEM THEREOF, AND DRIVING DEVICE

CROSS REFERENCE OF RELATED APPLICATIONS

This application claims priority to the Chinese Patent Application No. CN201811510600.7, filed with National Intellectual Property Administration, PRC on Dec. 11, 2018 and entitled "DRIVING METHOD OF DISPLAY MODULE, DRIVING DEVICE, AND DISPLAY DEVICE", and claims priority to the Chinese Patent Application No. CN201811511896.4, filed with National Intellectual Property Administration, PRC on Dec. 11, 2018 and entitled "DRIVING METHOD OF DISPLAY MODULE, DRIVING SYSTEM THEREOF, AND DISPLAY DEVICE", which are incorporated herein by reference in their entirety.

TECHNICAL FIELD

The present disclosure relates to a field of display panel technology, and in particular to a driving method of a display module, a driving system thereof, and a display device.

BACKGROUND

It should be understood that the statements herein merely provide background information related to the present disclosure and do not necessarily constitute prior art.

With the development and advancement of technology, liquid crystal displays have become mainstream products of displays because of their thin bodies, low power consumption and low radiation, and have been widely used. Conventional display apparatuses are mostly backlight display apparatuses, which includes a liquid crystal display (LCD) panel and a backlight module. Operating principle of the LCD panel is that liquid crystal (LC) molecules are disposed between two glass substrates, where the two glass substrates are parallelly disposed, and a driver voltage is applied on the two glass substrates to control rotation directions of the LC molecules, so that light of the backlight module are refracted to generate images.

A color deviation of a Large size LCD panel, especially a Vertical Alignment (VA) LCD panel, is severe.

SUMMARY

The present disclosure provides a driving method of a display module, a driving system thereof, and a display device to adjust an intensity of the light sources to improve color saturation and color deviation.

To achieve the above object, the present disclosure provides a driving method of a display module, includes a display panel driving process, and a backlight module driving process driven synchronously with the display panel driving process. The display module includes a plurality of first color light sources, second color light sources, and third color light sources. The first color light sources, the second color light sources, and the third color light sources are controlled independently.

The display panel driving process includes steps:

receiving first color signals corresponding to a display panel, and converting the first color signals into second color signals; and driving the display panel by the second color signals;

The backlight module driving process includes steps:

receiving the first color signals corresponding to the display panel, obtaining the second color signals, and obtaining a first light source adjustment coefficient and a second light source adjustment coefficient according to the first color signals and the second color signals;

obtaining a primary hue interval light source and a secondary hue interval light source of the first color light sources, the second color light sources, and the third color light sources by calculating;

adjusting a first brightness value corresponding to the primary hue interval light source by the first light source adjustment coefficient to obtain a second brightness value;

adjusting a first brightness value corresponding to the secondary hue interval light source by the second light source adjustment coefficient to obtain a third brightness value; and driving the primary hue light source by the second brightness value and driving the secondary light source by the third brightness value.

The present disclosure further provides a driving system of a display module, including a display panel driving circuit, and a backlight module driving circuit driven synchronously with the display panel driving circuit. The display module includes a plurality of first color light sources, second color light sources, and third color light sources. The first color light sources, the second color light sources, and the third color light sources are controlled independently.

The display panel driving circuit includes a color saturation adjustment circuit and a first driving circuit.

The color saturation adjustment circuit receives first color signals corresponding to a display panel and converts the first color signals into second color signals. The first driving circuit drives the display panel by the second color signals.

The backlight module driving circuit includes a light source adjustment calculation circuit, a light source adjustment circuit, a first light source adjustment circuit, a second light source adjustment circuit, and a second driving circuit. The light source adjustment calculation circuit receives the first color signals corresponding to the display panel, obtains the second color signals, and obtains a first light source adjustment coefficient and a second light source adjustment coefficient according to the first color signals and the second color signals. The light source adjustment circuit obtains a primary hue interval light source and a secondary hue interval light source of the first color light sources, the second color light sources, and the third color light sources by calculating. The first light source adjustment circuit adjusts a first brightness value corresponding to the primary hue interval light source by the first light source adjustment coefficient to obtain a second brightness value. The second light source adjustment circuit adjusts a first brightness value corresponding to the secondary hue interval light source by the second light source adjustment coefficient to obtain a third brightness value. And the second driving circuit drives the primary hue light source by the second brightness value and drives the secondary light source by the third brightness value.

The present disclosure further provides a display device including the driving system of the display module.

In the present disclosure, in a technique that is known but not disclosed by the applicant, since in an RGB (red, green, blue) system, different hues and different color saturation values lead to different color deviations. In order to solve the problem, the first color signals are converted into first color space signals in an HSV (hue, saturation, value) system. And then, the color saturation of the first color space signals is adjusted (in general, to lower the color saturation values) to obtain second color space signals. Then, the second color space signals are converted into the second color signals to drive the display panel. Thus, the color deviation is well improved. However, since the color saturation values are adjusted, a color saturation of the image is deteriorated. The second brightness value is configured to adjust an intensity of the light sources while adjusting the color saturation, thereby returning the color saturation signal that color saturation is damaged from an unsaturated color point to a saturated hue, which reduces the color deviation, especially reduces a wide viewing angle color deviation. And at the same time, a good color saturation is maintained, and a good color performance of solid colors is achieved.

And the second brightness value obtained by calculating drives the primary hue light source, and the third brightness value obtained by calculating drives the secondary hue light source. In a color saturation adjustment stage, when the color saturation values are different, due to different hues, the color deviation is different, and the color deviation is different. Generally, the color deviation corresponding to the primary hue light source is generally serious, and the color deviation corresponding to the secondary hue light source is light. Thus, the adjustment amplitude of the secondary hue light source is also different and may not even be adjusted. in this case, the primary hue light source is greatly compensated, and the secondary light source is compensated for a small amplitude, which is able to compensate a loss of the color saturation due to compensate for an improvement of the color deviation. Thus, a corresponding compensation effect is achieved, the color deviation is improved, the color saturation is improved, a balance of the color deviation and color saturation is achieved, and a display of the display panel is improved.

BRIEF DESCRIPTION OF DRAWINGS

The drawings are included to provide a further understanding of embodiments of the present disclosure, which form portions of the specification and are used to illustrate implementation manners of the present disclosure and are intended to illustrate operating principles of the present disclosure together with the description. Apparently, the drawings in the following description are merely some of the embodiments of the present disclosure, and those skilled in the art are able to obtain other drawings according to the drawings without contributing any inventive labor. In the drawing.

DETAILED DESCRIPTION

The present disclosure will be further described below in conjunction with the accompanying drawings and embodiments.

In a large-size liquid crystal display panel, especially in a Vertical Alignment (VA) type liquid crystal display panel, the corresponding wide viewing angle brightness is rapidly saturated with a voltage, resulting in a sharp contrast and a color deviation of image quality from a wide viewing angle compared to the image quality from a front view.

Figure 1:
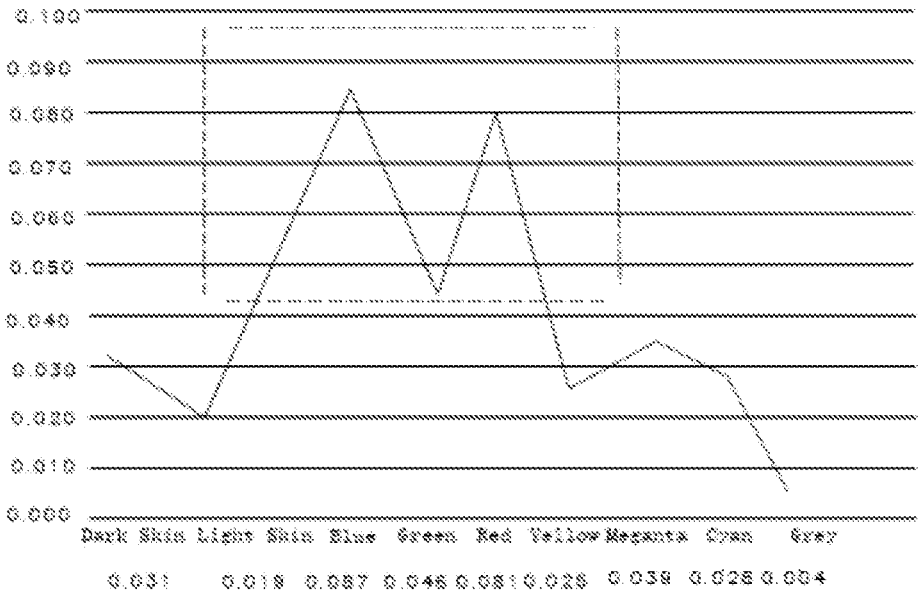
FIG. 1 is a schematic diagram of color deviation variations of a wide viewing angle and a front viewing angle of various representative color systems of a liquid crystal display.

FIG. 1 is a schematic diagram of color deviation variations of a wide viewing angle and a front viewing angle of various representative color systems of a liquid crystal display. As shown in FIG. 1, the ordinate indicates a degree of a color deviation, and it is obvious that the color deviation of R, G, and B hue is more severe than that of other colors. An exemplary solution is to divide the RGB (Red, Green, Blue) sub-pixels into main pixels/sub-pixels, so that an overall brightness viewed from wide viewing angle approaches the brightness viewed from a front viewing angle along with a variation of the voltage.

Figure 2:
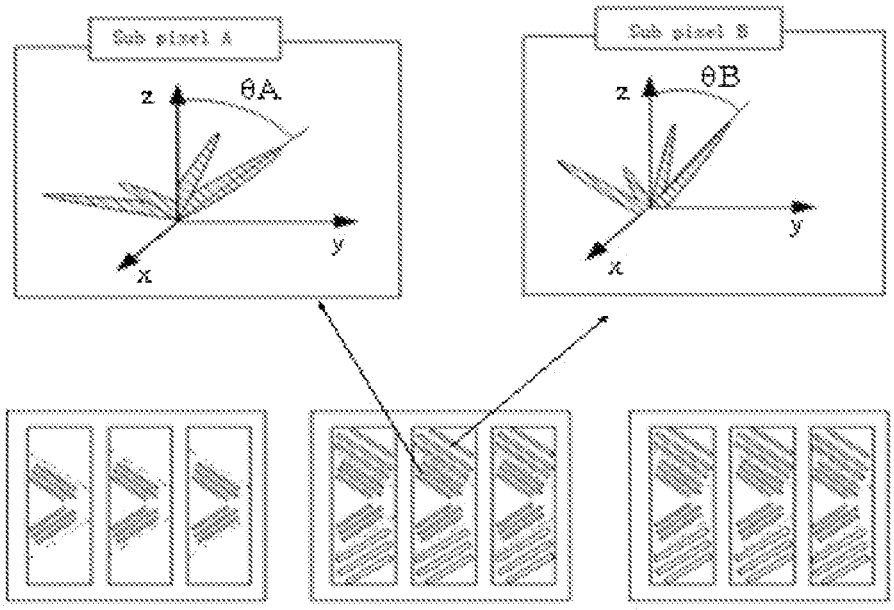
FIG. 2 is a first schematic diagram of dividing an original pixel into main pixels/sub-pixels in an exemplary scheme.
Figure 3:
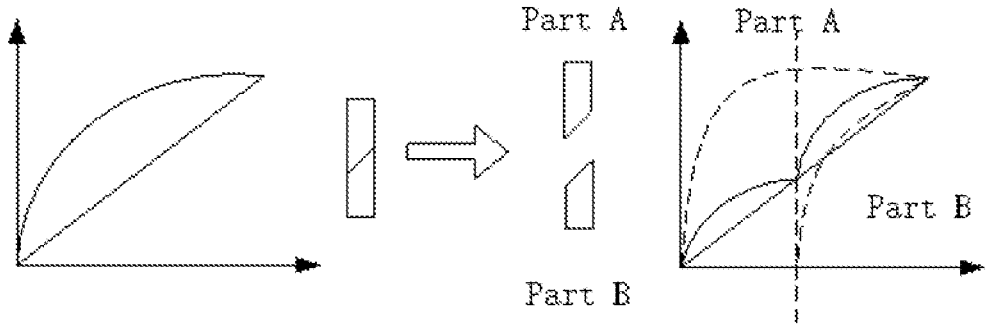
FIG. 3 is a second schematic diagram of dividing an original pixel into main pixels/sub-pixels in an exemplary scheme.

FIG. 2 is a first comparison diagram of distinguishing between original pixels and distinguishing main pixels and sub-pixels. FIG. 3 is a second comparison diagram of distinguishing between original pixels and distinguishing main pixels and sub-pixels. As shown in FIG. 2 and FIG. 3, the x coordinate, the y coordinate, and the z coordinate represent three directions of three-dimensional space respectively. The θA represents a pretilt angle of the main pixels at a large voltage, and θB represents a pretilt angle of the sub-pixels at a small voltage. The abscissa in FIG. 3 is a gray-scale signal, and the ordinate in FIG. 3 is a luminance signal. At a wide viewing angle, the brightness is rapidly saturated with the signal, leading to a large view color deviation (FIG. 3, the are segment on the left side). Dividing the pixels into main pixels and the sub-pixels is able to improve the phenomenon of color deviation to some extent.

To be specific, the original signals are divided into main pixels and sub-pixels with large voltage and small voltage. The large voltage and the small voltage on the front view are configured to make original front signals to change along with a brightness variation. Part A of FIG. 3 shows that the brightness in the large voltage viewing from side changes along with the grayscales. Part B of FIG. 3 shows that the brightness in the small voltage viewing from side changes along with the grayscale, in this way, the brightness of the side view synthesis changes with the grayscale as the arc in the left side, which is closer to the line in the right side, which indicates the brightness viewing from the front viewing angle along with the grayscale. Thus, the brightness viewing from the side view approaches the brightness viewing from the front view, and the color deviation caused by viewing from different angles is improved.

The defect is solved by applying different driving voltages on the main pixels and sub-pixels in space. However, it is need to re-design metal wires or thin film transistor (TFT) elements to drive the sub-pixels, which sacrifices a light-transmissive opening region, affects a panel penetration rate, and directly improves costs of the backlight.

Thus, the present disclosure provides a solution based on an improvement of different technical concepts, of which is as follows.

The present disclosure will be further described below in conjunction with the accompanying drawings and embodiments.

Figure 4:
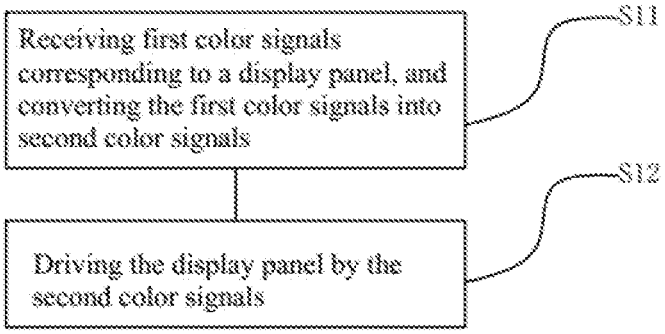
FIG. 4 is a flowchart of a display panel driving process according to one embodiment of the present disclosure.
Figure 5:
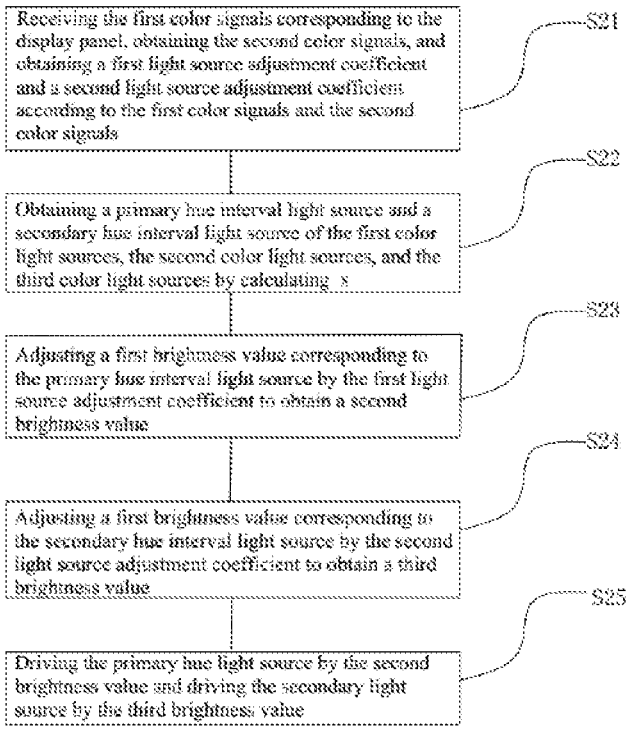
FIG. 5 is a flowchart of a backlight module driving process according to one embodiment of the present disclosure.

FIG. 4 is a flowchart of a display panel driving process according to one embodiment of the present disclosure. FIG. 5 is a flowchart of a backlight module driving process according to one embodiment of the present disclosure. As shown in FIGS. 4 and 5, the present disclosure provides a driving method of a display module, includes a display panel driving process, and a backlight module driving process driven synchronously with the display panel driving process. The display module includes a plurality of first color light sources, second color light sources, and third color light sources. The first color light sources, the second color light sources, and the third color light sources are controlled independently.

The display panel driving process includes steps:

S11: receiving first color signals corresponding to a display panel, and converting the first color signals into second color signals; and S12: driving the display panel by the second color signals;

The backlight module driving process includes steps:

S21: receiving the first color signals corresponding to the display panel, obtaining the second color signals, and obtaining a first light source adjustment coefficient and a second light source adjustment coefficient according to the first color signals and the second color signals;

S22: obtaining a primary hue interval light source and a secondary hue interval light source of the first color light sources, the second color light sources, and the third color light sources by calculating;

S23: adjusting a first brightness value corresponding to the primary hue interval light source by the first light source adjustment coefficient to obtain a second brightness value;

S24: adjusting a first brightness value corresponding to the secondary hue interval light source by the second light source adjustment coefficient to obtain a third brightness value; and S25: driving the primary hue light source by the second brightness value and driving the secondary light source by the third brightness value.

The driving system on which the driving method is applied is disposed at a front end of the display panel, specially disposed in a timing control chip of the display panel. The timing control chip further stores parameters such as the predetermined adjustment coefficient look up table related to the performance of the display panel corresponding to the driving system.

In the present disclosure, in a technique that is known but not disclosed by the applicant, since in the RGB system, different hues and different color saturation values lead to different color deviations. In order to solve the problem, the first color signals are converted into first color space signals in the HSV system. And then, the color saturation of the first color space signals is adjusted (in general, to lower the color saturation values) to obtain the second color space signals. Then, the second color space signals are converted into the second color signals to drive the display panel. Thus, the color deviation is well improved. However, since the color saturation value is adjusted, a color saturation of the image is deteriorated; The second brightness value is configured to adjust an intensity of the light source while adjusting the color saturation, thereby returning the color saturation signal that color saturation is damaged from an unsaturated color point to a saturated hue, which reduces the color deviation, especially reduces a wide viewing angle color deviation. And at the same time, a good color saturation is maintained, and a good color performance of solid colors is achieved.

And the second brightness value obtained by calculating drives the primary hue light source, and the third brightness value obtained by calculating drives the secondary hue light source. In a color saturation adjustment stage, when the color saturation values are different, due to different hues, the color deviation is different, and the color deviation is different. Generally, the color deviation corresponding to the primary hue light source is generally serious, and the color deviation corresponding to the secondary hue light source is light. Thus, the adjustment amplitude of the secondary hue light source is also different and may not even be adjusted. in this case, the primary hue light source is greatly compensated, and the secondary light source is compensated for a small amplitude, which is able to compensate a loss of the color saturation due to compensate for an improvement of the color deviation. Thus, a corresponding compensation effect is achieved, the color deviation is improved, the color saturation is improved, a balance of the color deviation and color saturation is achieved, and a display of the display panel is improved.

Figure 6:
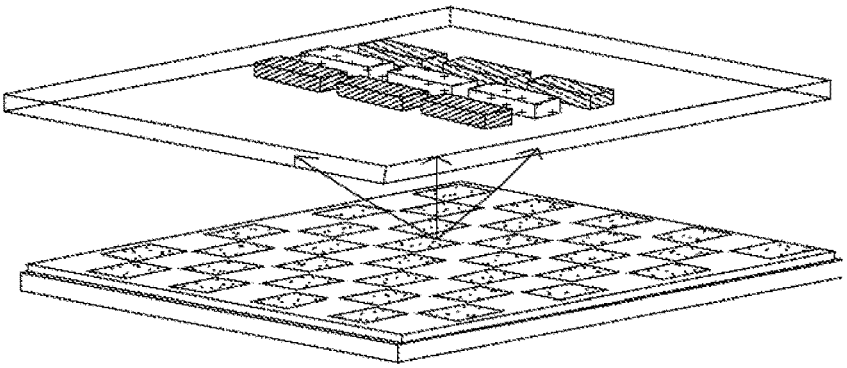
FIG. 6 is a schematic diagram of a direct-lit display module of the present disclosure.

FIG. 6 is a schematic diagram of a direct-lit display module of the present disclosure. As shown in FUG. 6, and further combined with FIGS. 4 and 5, in one embodiment, the display module is a direct-lit backlight display module. The direct-lit backlight display module includes a plurality of backlight partitions. Each of the backlight partitions includes the plurality of the first color light sources and the second color light sources.

Each of the backlight partitions further includes a plurality of third color light sources, and the third color light sources are controlled independently.

The backlight partitions may include three light sources controlled independently as shown in FIG. 6 and may adapt to other structures.

In one embodiment, the step of obtaining the first light source adjustment coefficient and the second light source adjustment coefficient according to the first color space signals and the second color space signals includes steps:

obtaining the first color space signals and the second color space signals of all pixels in current backlight partitions corresponding to a current frame, calculating a first average color saturation signal corresponding to the first color space signals and a second average color saturation signal corresponding to the second color space signals respectively; and obtaining the first light source adjustment coefficient and the second light source adjustment coefficient by calculating the first average color saturation signal and the second average color saturation signal.

In one embodiment, the step of obtaining the light source adjustment coefficient according to the first color space signals and the second color space signals includes steps:

obtaining the first color space signals and the second color space signals of all pixels in current backlight partitions corresponding to a current frame, calculating a first average color saturation signal corresponding to the first color space signals and a second average color saturation signal corresponding to the second color space signals respectively; and obtaining the light source adjustment coefficient by calculating the first average color saturation signal and the second average color saturation signal.

In the embodiment, the intensity of the light sources is adjusted in units of one backlight partition. First, comparing a difference between the color saturation of the first color signals and the second color signals before a color saturation adjustment operation and the color saturation of the first color signals and the second color signals after the color saturation adjustment operation by measuring the first average color saturation signal Sn_ave corresponding to the first color space signals, and the second average color saturation signal S'n_ave corresponding to the second color space signals. Then, based on the difference, the light source adjustment coefficient is calculated, so that the backlight partitions of the display panel improve the color deviation, and the backlight partitions are regarded as one, and each of the backlight partitions separately compensates the color saturation to maintain a good solid color performance of colors.

In one embodiment, the first color signals are RGB three primary color signals in the RGB system, and the first color signals includes red sub-pixel signals, green sub-pixel signals, and blue sub-pixel signals.

The step of obtaining the first light source adjustment coefficient and the second light source adjustment coefficient according to the first color signals and the second color signals includes steps:

obtaining the first color signals of all pixels in the current backlight partitions corresponding to the current frame, calculating a maximum average signal of the first color signals maxn_ave, a medium average signal of the first color signals mid_nave and a minimum average signal of the first color signals minn_ave among a red sub-pixel average signal of the first color signals, a green sub-pixel average signal of the first color signals, and a blue sub-pixel average signal of the first color signals; and obtaining the first average color saturation signal Sn_ave by calculating the maximum average signal of the first color signals and the minimum average signal of the first color signals, Sn_ave=1−minn_ave/maxn_ave;

calculating a maximum average signal of the second color signals max'n_ave, a medium average signal of the second color signals, and a minimum average signal of the second color signals min'n_ave;

obtaining the second average color saturation signal S'n_ave by calculating the maximum average signal of the second color signals and the minimum average signal of the second color signals, S'n_av=1−min'n_ave/max'n_ave; and calculating the first light source adjustment coefficient y according to the first average color saturation signal and the second average color saturation signal, and the light source adjustment coefficient y satisfies following formulas:

$$Sn_ave=1-min n_ave/max n_ave=1-min'n_ave/(max'n_ave*y);\ \text{and}$$

$$y=(min'n_ave*max n_ave)/(min n_ave*max'n_ave);\ \text{and}$$

calculating the second light source adjustment coefficient x according to the first light source adjustment coefficient y, and the second light source adjustment coefficient x satisfies following formulas:

$$max n_ave/mid n_ave=max'n_ave*y/mid'n_ave*x;\ \text{and}$$

$$x=(min'n_ave*mid n_ave Y(min n_ave*mid'n_ave).$$

In one embodiment, the step of calculating the first average color saturation signal Sn_ave includes steps:

obtaining the first color signals Rn_i, j, Gn_i, j, Bn_i, j, and converting each group of RGB three primary color sub-pixel grayscale signals into three primary color normalized luminance signals r, g, b; and obtain first normalized luminance signals rn_i,j, gn_i,j, bn_i,j after completing the conversion;

calculating a red sub-pixel average signal rn_ave, a green sub-pixel average signal gn-ave, and a blue sub-pixel average signal bn-ave of the first color signals of all pixels in the current backlight partitions corresponding to the current frame;

calculating the maximum average signal of the first color signals maxn-ave, the medium average signal of the first color signals mid_nave, and the minimum average signal of the first color signals minn-ave among three sub-pixel average signals; and obtaining the first average color saturation signal by calculating the maximum average signal of the first color signals and the minimum average signal of the first color signals, and Sn_ave=1−minn_ave/maxn_ave.

where r=(R/255)^γr, g=(G/255)^γg, b=(B/255)^γb, and γr, γg, γb are gamma signals of the first color signals. The R, G, and B refer to RGB three primary color grayscale digital signals corresponding to the first color signals. The maximum average signal of the first color signals maxn_ave=Max(rn_ave, gn_ave, bn_ave). The medium average signal of the first color signals mid_nave=Mid(rn_ave, gn_ave, bn_ave). And the minimum average signal of the first color signals minn_ave=Min(rn_ave, gn_ave, bn_ave).

Where rn_ave=Average(rn_1,1, rn_1,2, . . . , rn_i,j), gn_ave=Average(gn_1,1, gn_1,2, . . . , gn_i,j), and bn_ave=Average(bn_1,1, bn_1,2, . . . , bn_i,j).

The step of calculating the second average color saturation signal S'n_ave includes steps:

obtaining the second color signals R'n_i, j, G'n_i, j, B'n_i, j, and converting each group of RGB three primary color sub-pixel grayscale signals into three primary color normalized luminance signals r', g', b'; and obtain the second normalized luminance signals r'n_i,j, g'n_i,j, b'n_i,j after completing the conversion;

calculating a red sub-pixel average signal r'n_ave, a green sub-pixel average signal g'n-ave, and a blue sub-pixel average signal b'n-ave of the second color signals of all pixels in the current backlight partitions corresponding to the current frame;

calculating the maximum average signal of the second color signals maxn-ave, the medium average signal of the second color signals mid_nave, and the minimum average signal of the second color signals minn-ave among three sub-pixel average signals; and obtaining the second average color saturation signal by calculating the maximum average signal of the first color signals and the minimum average signal of the first color signals, and S'n_ave=1−min'n_ave/max'n_ave.

Where r'=(R'/255)^γr, g'=(G'/255)^γg, b'=(B'/255)^γb, and γ'r, γ'g, γ'b are gamma signals of the second color signals.

The R', G', and B' refer to RGB three primary color grayscale digital signals corresponding to the second color signals.

The maximum average signal of the second color signals max'n_ave=Max(r'n_ave, g'n_ave, b'n_ave). The medium average signal of the second color signals mid'_nave=Mid (r'n_ave, g'n_ave, b'n_ave). And the minimum average signal of the second color signals min'n_ave=Min(r'n_ave, g'_ave, b'n_ave).

And r'n_ave=Average(r'n_1,1, r'n_1,2, . . . , r'n_i,j), g'n_ave=Average(g'n_1,1, g'n_1,2, . . . , g'n_i,j), b'n_ave=Average(b'n_1,1, b'n_1,2, . . . , b'n_i,j).

In the embodiment, all R, G, B sub-pixels are a group of unit pixels in the backlight partition, and are converted into HSV systems from the RGB system. That is, the first normalized luminance signals rn_i, j, gn_i, j, bn_i, j are obtained according to a normalization operation of the stimulation value signals Rn_i, j, Gn_i, j, Bn_i, j, then calculate the first color space signals based on the first normalized luminance signals. And then performing an adjustment process on the color saturation signals of the first color space signals, and the second normalized luminance signals are obtained according to the normalization operation based on the adjusted second color space signals, and then inversely convert to get the corresponding stimulation function r'n_i,j, g'n_i,j, b'n_i,j. Then, the first average color saturation signal and the second average color saturation signal are calculated basing on the original stimulation function rn_i,j, gn_i,j, bn_i,j and new stimulation value signals r'n_i,j, g'n_i,j, b'n_i,j. Since the brightness stimulation value of each unit pixel is actually calculated during the calculation process, the final calculated light source adjustment coefficient is calculated basing on a comparison of actual pixel presentations. Thus, the calculated light source adjustment coefficient y is accurate, which makes the color saturation compensation has a good effect, and is well to compensate the loss of the color saturation while improving the color deviation.

In one embodiment, the step of receiving first color signals corresponding to the display panel, and converting the first color signals into second color signals includes steps:

receiving the first color signals in the RGB system corresponding to the display panel, and converting the first color signals into first color space signals in an HSV system;

obtaining current color saturation signals of the first color space signals, and obtaining predetermined adjustment coefficients corresponding to the current color saturation signals;

lowering color saturation values of the current color saturation signals by the predetermined adjustment coefficients, completing an adjustment process of the current color saturation signals, and obtaining the second color space signals in the HSV system; and converting the second color space signals into second color signals in the RGB system.

The step of obtaining the first light source adjustment coefficient and the second light source adjustment coefficient according to the first color signals and the second color signals includes steps:

obtaining the first color space signals and the second color space signals of all pixels in current backlight partitions corresponding to the current frame, calculating the first average color saturation signal corresponding to the first color space signals and the second average color saturation signal corresponding to the second color space signals respectively; and obtaining the first light source adjustment coefficient and the second light source adjustment coefficient by calculating the first average color saturation signal and the second average color saturation signal.

Calculating the first light source adjustment coefficient and the second light source adjustment coefficient includes steps:

calculating the first average color saturation signal corresponding to the first color space signals by using a formula Sn_ave=Average(Sn_1,1, Sn 1,2, . . . , Sn_i,j):

calculating the second average color saturation signal corresponding to the second color space signals by using a formula S'n_ave=Average(S'n_1,1, S'n_1,2, . . . , S'n_i,j); and obtaining the first light source adjustment coefficient and the second light source adjustment coefficient by calculating the first average color saturation signal Sn_ave and the second average color saturation signal S'n_ave.

In one embodiment, the step of converting the first color signals into first color space signals in the HSV system includes steps:

obtaining the first color signals Rn_i, j, Gn_i, j, Bn_i, j, and converting each group of RGB three primary color sub-pixel grayscale signals into three primary color normalized luminance signals r, g, b; and obtain first normalized luminance signals rn_i,j, gn_i,j, bn_i,j after completing the conversion;

converting the first color signals into first color space signals according to the first normalized luminance signals, and S=1−mini,j/maxi,j.

The step of lowering the color saturation values of the current color saturation signals by the predetermined adjustment coefficients, completing the adjustment process of the current color saturation signals, and obtaining the second color space signals in the HSV system includes steps:

keeping mini,j unchanged while adjusting mini,j by the predetermined adjustment coefficients; and completing an adjustment of the color saturation signals to obtained the second color space signals in the HSV system S'=1−mini,j*H/maxi,j.

The mini,j=min (rn_i,j, gn_i,j, bn_i,j), and maxi,j=max (rn_i,j, gn_i,j, bn_i,j).

Sn_i,j=1−minn_i,j/maxn_i,j, and minn_i,j=min (r,g,b); maxn_i,j=max (r,g,b), and r=(R/255)^γr, g=(G/255)^γg, b=(B/255)^γb. γr, γg, γb are gamma signals of the first color signals. The R, G, and B refer to RGB three primary color grayscale digital signals corresponding to the first color signals.

In the embodiment, corresponding to the first color space signals corresponding to the first color signals and the second color space signals corresponding to the second color signals, average values of all color saturation signals in the backlight partitions are respectively calculated to obtain the first average color saturation signal and the second average color saturation signal. And the display difference of the backlight partitions between the color saturation before the adjustment and the color saturation after the adjustment (in order to improve the color deviation) is reflected by the first average color saturation signal and the second average color saturation signal, thus, the light source adjustment coefficients are calculated, the calculation step is simple. Based on the overall display effect, the production efficiency is improved, and overall uniformity of the color saturation of the backlight partitions is maintained, and the local color saturation is prevented from being too high or too low, which is beneficial for improving the display.

In one embodiment, the step of obtaining the first light source adjustment coefficient and the second light source adjustment coefficient by calculating the first average color saturation signal Sn_ave and the second average color saturation signal S'n_ave includes steps:

calculating the first average color saturation signal by using a formula Sn_ave=1−minn_ave/maxn_ave;

calculating the second average color saturation signal by using a formula S'n_ave=1−min'n_ave/max'n_ave; and obtaining a third average color saturation signal S"n_ave according to the first light source adjustment coefficient and the second average color saturation signal;

where the first light source adjustment coefficient y satisfies following formulas:

$$S''n_ave = Sn_ave, \text{ and}$$

$$1 - min n_ave / max n_ave = 1 - min' n_ave / (max n_ave * y), \text{ and}$$

$$y = (S'n_ave - 1)/(Sn_ave - 1); \text{ and}$$

calculating the second light source adjustment coefficient x according to the first light source adjustment coefficient y, and the second light source adjustment coefficient x satisfies following formulas:

$$max n_ave / mid n_ave = max n_ave * y / mid' n_ave * x;$$

$$x = (min' n_ave * mid n_ave)/(min n_ave * mid' n_ave.$$

The maxn_ave is the maximum average signal of the first color signals among the red sub-pixel average signal, the green sub-pixel average signal, and the blue sub-pixel average signal of the first color signals of all pixels in the current backlight partitions corresponding to the current frame. The midn_ave is the medium average signal of the first color signals among the red sub-pixel average signal, the green sub-pixel average signal; and the blue sub-pixel average signal of the first color signals of all pixels in the current backlight partitions corresponding to the current frame. And the minn_ave is the minimum average signal of the first color signals among the red sub-pixel average signal, the green sub-pixel average signal, and the blue sub-pixel average signal of the first color signals of all pixels in the current backlight partitions corresponding to the current frame.

The maxn_ave is also the maximum average signal of the second color signals among a red sub-pixel average signal, a green sub-pixel average signal, and a blue sub-pixel average signal of the second color signals of all pixels in the current backlight partitions corresponding to the current frame, mid'n_ave is the medium average signal of the second color signals among the red sub-pixel average signal, the green sub-pixel average signal; and the blue sub-pixel average signal of the first color signals of all pixels in the current backlight partitions corresponding to the current frame; and min'n_ave is the minimum average signal of the second color signals among the red sub-pixel average signal, the green sub-pixel average signal, and the blue sub-pixel average signal of the second color signals of all pixels in the current backlight partitions corresponding to the current frame.

In one embodiment, the step of adjusting the color saturation of the first color signals to obtain the second color signals includes steps:

obtaining the first color signals in an RGB system, and converting the first color signals in the RGB system into first color space signals in an HSV system;

obtaining current color saturation signals of the first color space signals, detecting whether the current color saturation signals satisfy a predetermined color saturation threshold, and detecting whether the current color saturation signals are in an adjusted hue interval, and if yes, obtaining corresponding predetermined adjustment coefficients according to the corresponding color saturation values and corresponding hue intervals based on the color saturation signals; and adjusting the current color saturation signals to obtain the second color space signals in the HSV system by the predetermined adjustment coefficients.

The predetermined adjustment coefficients are obtained by calculating the color saturation signals according to a predetermined calculation formula or by looking up in a predetermined adjustment coefficient look up table.

To be specific, obtaining the first color signals Rn_i, j, Gn_i, j, Bn_i,j, and converting each group of RGB three primary color sub-pixel grayscale signals into three primary color normalized luminance signals r, g, b; and obtain first normalized luminance signals rn_i,j, gn_i,j, bn_i,j after completing the conversion;

receiving the first color signals in the RGB system, obtaining the first color signals Rn_i, j, Gn_i, j, Bn_i, j, and converting each group of the RGB three primary color sub-pixel grayscale signals into the three primary color normalized luminance signals r, g, b, and obtaining the first normalized luminance signals rn_i,j, gn_i,j, bn_i,j after completing the conversion;

calculating the current color saturation signals according to the first normalized luminance signals by S=1−mini,j/maxi,j, and obtaining the predetermined adjustment coefficients H corresponding to the current color saturation signals S;

keeping maxi, j unchanged, and adjusting the mini, j by the predetermined adjustment coefficients H to obtain the second color saturation signals, and S'=1−mini,j*H/maxi,j; and converting the second color saturation signals S' into the second color signals in the RGB system to drive the display panel, and mini,j=min(rn_i,j, gn_i,j, bn_i,j), and maxi,j=max (rn_i,j, gn_i,j, bn_i,j).

The adjustment coefficient look up table is a look up table directly recorded with predetermined adjustment coefficients, or is a look up table recording a predetermined calculation formula.

The second color space signals and the first color space signals conform to a following formula:

$$S' = a*S4 + b*S3 + c*S2 + d*S + e;$$

S is the current color saturation signals corresponding to the first color space signals, and S' is the color saturation signal corresponding to the second color space signals. The a, b, c, d, e are constants, and the a, b, c, d, e are obtained by looking up in the predetermined formula coefficient look up table according to the different color saturation values and the different hue intervals. In the embodiment, the predetermined adjustment coefficients are calculated according to the predetermined calculation formulas, and although the calculation formulas are different, it is generally satisfied with the fourth-order polynomial. The a, b, c, d, e are constants, and the a, b, c, d, e are obtained by looking up in the predetermined formula coefficient look up table according to the different color saturation values and the different hue intervals. Of course, other calculation formulas are also applicable. For example, when the color saturation value S satisfies certain conditions, the predetermined adjustment coefficient is equal to the square root of S. When the color saturation value S satisfies another condition, the predetermined adjustment coefficient is equal to the cubic root of S.

The color saturation threshold is 0.5, and if the color saturation values of the current color saturation signals are more than 0.5, the color saturation values of the current color saturation signals satisfy the color saturation threshold. Or the color saturation threshold is an interval, e. g. 0.5-1, that is, the color saturation threshold is more than 0.5 and less than 1. When the color saturation threshold is more than 0.5 and less than 1, the color saturation is adjusted. When the color saturation threshold is 0.5 or 1, there is no need to adjust the color saturation.

In the embodiment, in the RGB system, the higher the color saturation of the signals, the more severe the color deviation is. Thus, the color deviation of some of the color saturation values is severe, and the color deviation of some of the color saturation values is not obvious and is in an acceptable range. The color saturation signals with severe color saturation are sift out by the hue interval and the predetermined threshold. For example, to lower the color saturation values is able to improve the color deviation, and avoid unnecessary processing for signals that does not need the color deviation adjustment (such as lowering the color saturation values), thereby improving the display of the display panel.

To be specific, the color saturation signals are split into at least a first hue interval, a second hue interval, and a third hue interval according to different hues;

In the step of obtaining the predetermined adjustment coefficients corresponding to the current color saturation signals, when corresponding to a same hue, the greater the color saturation values of the current color saturation signals, the greater an adjustment amplitude of the adjustment process is.

In the embodiment, in the same hue interval, especially in the same hue, the higher the color saturation values of the color saturation signals, the more severe the corresponding color deviation is. Therefore, the adjustment amplitude for the signals with a high color saturation value is large, and the adjustment amplitude for the signals with a low color saturation value is small. In generally, the color saturation values of the color saturation signals are lowered, thus, the color deviation caused by the high color saturation is avoided, the color deviation caused by excessive color saturation difference is avoided, and a good effect of the improvement of the color deviation is achieved. Of course, it is possible to increase the value of the color saturation signals with a low color saturation value, which makes the color saturation signals more uniform and also improves the color deviation to some extent.

In addition, the adjustment amplitude herein refers to lower the amplitude of the color saturation signals. The larger the color saturation values, the corresponding predetermined adjustment coefficient may be smaller or larger according to different calculation formulas. However, an effect of the adjustment amplitude is constant. For example, if the predetermined adjustment coefficient are the coefficient of the overall color saturation signals, e. g. $S'=S*H$ (where S is the current color saturation signals and S' is the second color saturation signals, H is the predetermined adjustment coefficients), the greater the adjustment amplitude of lowering the value, the smaller the value of the predetermined adjustment coefficients. If the predetermined adjustment coefficient is the coefficient of one of the parameters of the color saturation signals, e. g. $S'=1-min*H/max$ (where S is the current color saturation signal, S' is the second color saturation signal, and H is the predetermined adjustment coefficient), the greater the adjustment amplitude of lowering the value, the greater the corresponding coefficient is. The larger the predetermined adjustment coefficient at this time, the larger the corresponding reduction adjustment amplitude is.

To be specific, the first hue interval, the second hue interval, and the third hue interval are defined as a red hue interval, a green hue interval, and a blue hue interval respectively. In the current color saturation signals having the same color saturation value, the adjustment amplitude of the predetermined color adjustment signals corresponding to the blue hue interval to the current color saturation signals is greater than the adjustment amplitude of the predetermined color adjustment signals corresponding to the red hue interval to the current color saturation signals. The adjustment amplitude of the predetermined color adjustment signals corresponding to the red hue interval to the current color saturation signals is greater than the adjustment amplitude of the predetermined color adjustment signals corresponding to the green hue interval to the current color saturation signals. In the embodiment, the degrees of color deviation of the color saturation signals in different hue intervals are different. In the same color saturation value, the color deviation of some of the hue intervals is severe, and the color deviation of some hue intervals is light. In RGB system, the color deviation of color saturation signals in the blue hue interval is the most severe, and the color deviation of color saturation signals in the green hue interval is lighter. In this scheme, taking $S'=S*H$ as an example, the predetermined adjustment coefficients corresponding to the blue hue interval are smaller than the predetermined adjustment coefficients corresponding to the red hue interval, and the predetermined adjustment coefficients corresponding to the red hue interval are smaller than the predetermined adjustment coefficients corresponding to the green hue interval. The smaller the predetermined adjustment coefficients, the larger the adjustment amplitude is. Correspondingly, taking $S'=1-min*H/max$ as an example, the predetermined adjustment coefficients corresponding to the blue hue interval are the largest among the hue intervals and the adjustment amplitude is the largest, and the predetermined adjustment coefficients corresponding to the green hue interval are the smallest among the hue intervals and the adjustment amplitude is the smallest. Thus, in the same color saturation value, the color saturation signals in the blue hue interval have the larger reduction adjustment amplitude, and the color saturation signals in the green hue interval have the smaller reduction adjustment amplitude, which not only reduce the color deviation caused by the large color saturation values, but also make the color saturation of the color saturation signals more uniform, and also help to improve color deviation to some extent. Thus, the good improvement in color deviation is achieved.

In one embodiment, the color saturation signals are split into a red hue interval, a green hue interval, a blue hue interval, and an unadjusted hue interval according to different hue intervals.

A hue value ranges from 0-360, corresponding to 0-360 degrees.

The hue value of a hue interval satisfying a following formula is the red hue interval: $0 \leq Hue < 40$, or $320 < Hue$ ≤360. The hue value of the hue interval satisfying a following formula is the green hue interval: 80<Hue <160. The hue value of the hue interval satisfying a following formula is the blue hue interval: 40≤Hue ≤80, or 160≤Hue ≤200. The hue value of the hue interval satisfying the following formula is the unadjusted hue interval: 40≤Hue ≤80, or 160≤Hue ≤200, or 280≤Hue ≤320. In the embodiment, in view of the RGB system, 0 degree is defined as a red hue, 120 degrees is defined as a green hue, and 240 degrees is defined as a blue hue. Under the premise of the same color saturation value, the closer to the red hue, the green hue, and the blue hue, the more severe the color deviation is. The farther away from the red hue, the green hue, and the blue hue, the lighter the color deviation of the color saturation signals is, and even the color saturation signals conform to the color deviation standard and does not need to be adjusted. In the embodiment, the hues close to the green hue is defined as the green hue interval, the hues close to the blue hue is defined as the blue hue interval, the hues close to the red hue is defined as a red hue interval, and the hues away from the red hue, the green hue, and the blue hue is defined as the unadjusted interval. Thus, corresponding to the same color saturation value, the predetermined adjustment coefficients of the blue hue interval having the most severe color deviation are set to be large, the predetermined adjustment coefficients of the green hue interval having the lightest color deviation are set to be small, and for the unadjusted hue interval where there is almost no color deviation, no adjustment is made, or the corresponding predetermined adjustment coefficients is set to be 1. In this way, the color deviation is improving, the decrease of the color saturation values are avoided, which is beneficial to improve the display of the display panel.

In one embodiment, the step of adjusting the current color saturation signals to obtain the second color space signals in the HSV system by the predetermined adjustment coefficients includes steps:

obtaining the third color saturation signals S" by calculating the current color saturation signals S and the second color saturation signals S';

completing two times of color saturation adjustment; and obtaining the second color space signals in the HSV system based on the third color saturation signals; and converting the second color space signals into the second color signals in the RGB system to drive the display panel.

Figure 7:
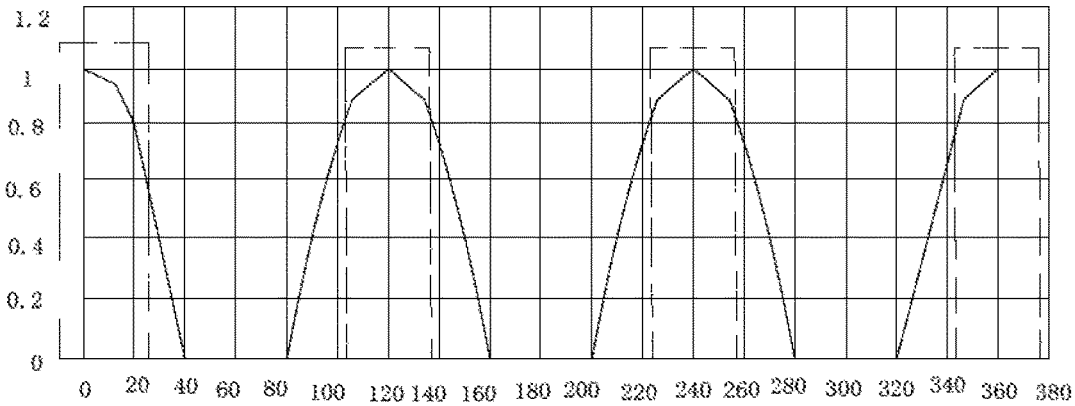
FIG. 7 is a schematic diagram of a correlation function of a second predetermined adjustment coefficient H2 in one embodiment of the present disclosure.

FIG. 7 is a schematic diagram of a correlation function of a second predetermined adjustment coefficient H2 in one embodiment of the present disclosure. As shown in FIG. 7, and combined with FIGS. 4 to 6, the third color saturation signals satisfies a following formula: S"=S−(S−S')*H2.

The second predetermined adjustment coefficient H2 satisfies a following formula: H2=2*ABS(sin((Hue/360*3−½)*π)−1.

In the embodiment, the second predetermined adjustment coefficients H2 is an adjustment coefficient configured to adjust the second color saturation signals into the third color saturation signals. In the RGB system, 0 degree is defined as a red solid color hue, 120 degrees is defined as a green solid color hue, and 240 degrees is defined as a blue solid color hue. In the same color saturation value, the closer to the solid color hue, the more severe the color deviation is. Base on the second predetermined adjustment coefficients H2, the color saturation signals closer to the solid color hue obtains a larger secondary adjustment, and the color saturation signals away from the solid color hue obtains a small amplitude secondary adjustment. In this way, the color saturation signals near the solid color hue achieves a good effect of improving the color deviation, while for the color saturation signals away from the solid color hue, the overall color saturation damage caused by the improvement of the color deviation is lowered. Thus, The balance of the color deviation and the color saturation is achieved, which is beneficial to improve the display of the display panel.

Figure 8:
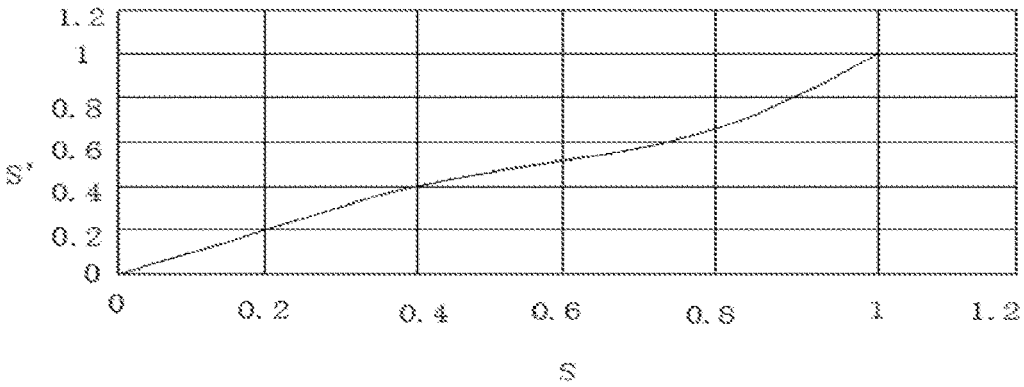
FIG. 8 is a schematic diagram of variations of a current color saturation signal and the second color saturation signal according to one embodiment of the present disclosure.
Figure 9:
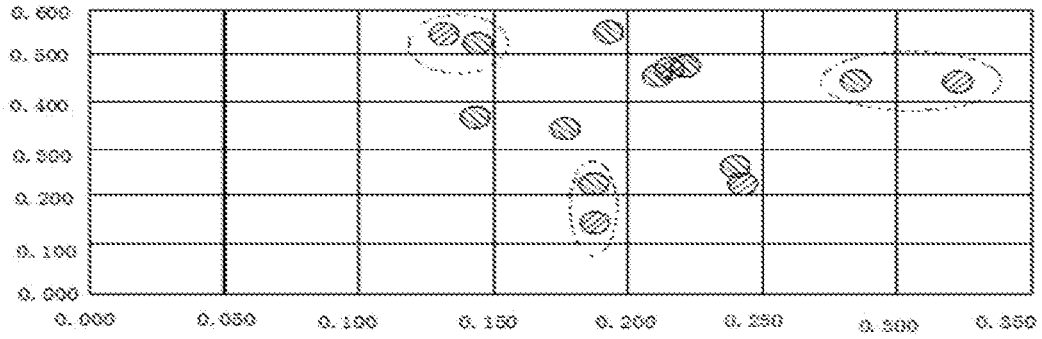
FIG. 9 is a graph showing aberration variations of the current color saturation signal and the second color saturation signal according to one embodiment of the present disclosure.
Figure 10:
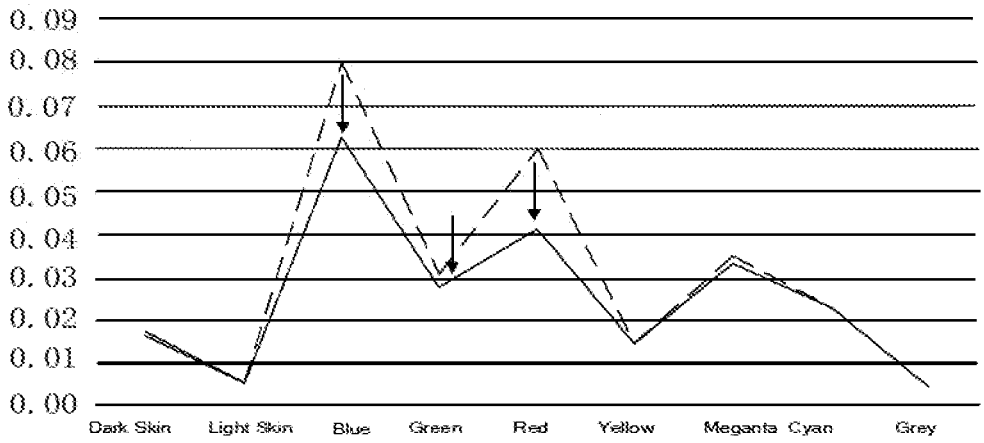
FIG. 10 is a schematic diagram of aberration variations of the current color saturation signal and the second color saturation signal according to one embodiment of the present disclosure.

In the color saturation adjustment stage:

FIG. 8 is a schematic diagram of variations of a current color saturation signal and a second color saturation signal according to one embodiment of the present disclosure FIG. 9 is a graph showing an aberration variation of the current color saturation signal and the second color saturation signal according to one embodiment of the present disclosure. FIG. 10 is a schematic diagram of aberration variations of the current color saturation signal and the second color saturation signal according to one embodiment of the present disclosure.

The graph of the aberration variation shown in FIG. 9 may be in the case of a front viewing angle, of course, it can also be in the case of a side viewing angle. The dotted line in FIG. 10 is the aberration variation corresponding to the current color saturation signal in various color systems, and the solid line is the aberration variation corresponding to the second color saturation signal in various color systems. To be specific, the input signals of the display is RGB three primary color signals. If the display is driven by 8-bit color resolution, the tone of the RGB three primary color input signals are decomposed into 0, 1, 2 . . . 255 grayscale drive signals. In the present disclosure, the RGB three primary color signals are converted into HSV color space signals, and the color saturation is adjusted according to different hues and different color saturation values in the color space of the HSV to achieve the effect of the improvement of the color deviation.

R is a red grayscale digital signal, G is a green grayscale digital signal, B is a blue grayscale digital signal. And min is the minimum of r, g, b, and max is the maximum of r, g, b.

The conversion relationship between r, g, b normalized luminance signals and hue h, and the saturation signals conform to a following formula:

$$h=\begin{cases}0^\circ & \text{if } \max=\min\\ 60^\circ\times\dfrac{g-b}{\max-\min}+0^\circ & \text{if } \max=r \text{ and } g\geq b\\ 60^\circ\times\dfrac{g-b}{\max-\min}+360^\circ & \text{if } \max=r \text{ and } g<b\\ 60^\circ\times\dfrac{b-r}{\max-\min}+120^\circ & \text{if } \max=g\\ 60^\circ\times\dfrac{r-g}{\max-\min}+240^\circ & \text{if } \max=b\end{cases}$$

$$s=\begin{cases}0^\circ & \text{if } \max=0\\ 1-\dfrac{\min}{\max}, & \text{otherwise}\end{cases}$$

In summary, when the hue is close to the R, G, B solid color hue, the color deviation deterioration of the wide viewing angle is more obvious. And when the hue is close to the R, G, B solid color hue, the greater the color saturation s, the more obvious the color deviation is. The color saturation s of the R, G, B solid color hues are lowered to improve the color viewed from the wide viewing angle comparing to the color viewed from the front view angel, that is, the closer to the solid color hue, the greater the adjustment amplitude is.

In addition, after completing the color saturation adjustment, a detection step is added. For example, converting the color saturation signals into the Commission International De l'Eclairage Lu'v'color space signals, where L is a luminance coordinate and u' and v' are chroma coordinates. In order to improve the color deviation, the color saturation adjustment is to lower the color saturation values of the current color saturation signals, but if it is to reduce a loss of the color saturation, the solid color changes, that is, the current color saturation signals S are changed to the second color saturation signals S'. And the solid color change or the aberration Δuv should satisfy:

$\Delta uv=\sqrt{((u_1-u_2)^2+(v_1-v_2)^2)}\leq 0.02$. Where u_1 and v_1 are the chroma coordinates of the current color saturation signal, and u_2 and v_2 are the chroma coordinates of the second color saturation signals which are the color saturation signal after the color saturation adjustment.

Figure 11:
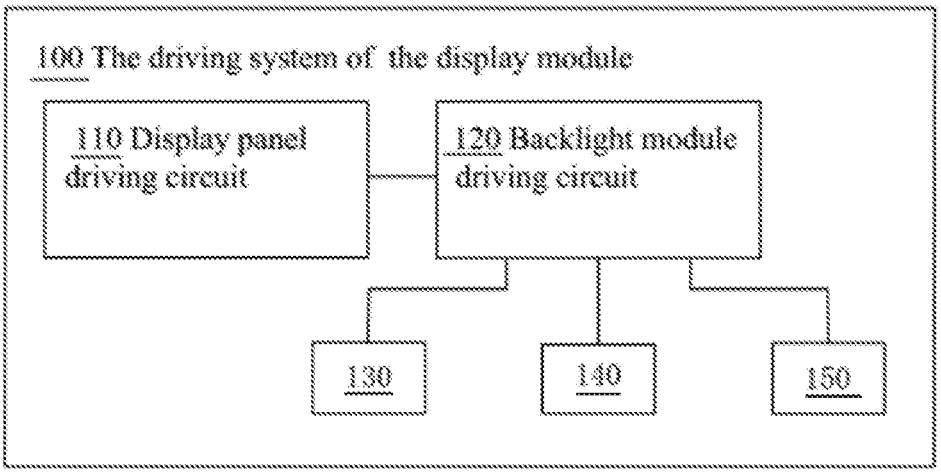
FIG. 11 is a schematic diagram of a driving system of a display panel according to one embodiment of the present disclosure.
Figure 12:
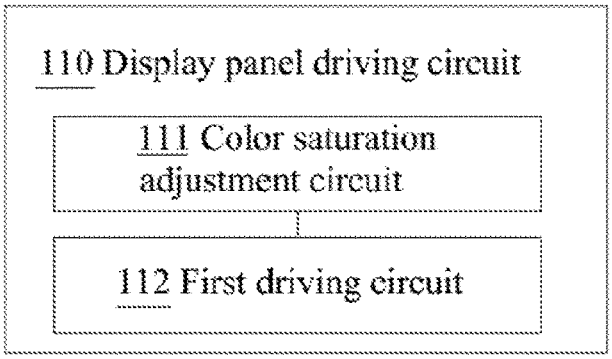
FIG. 12 is a schematic diagram of a driving circuit of a display panel according to one embodiment of the present disclosure.
Figure 13:
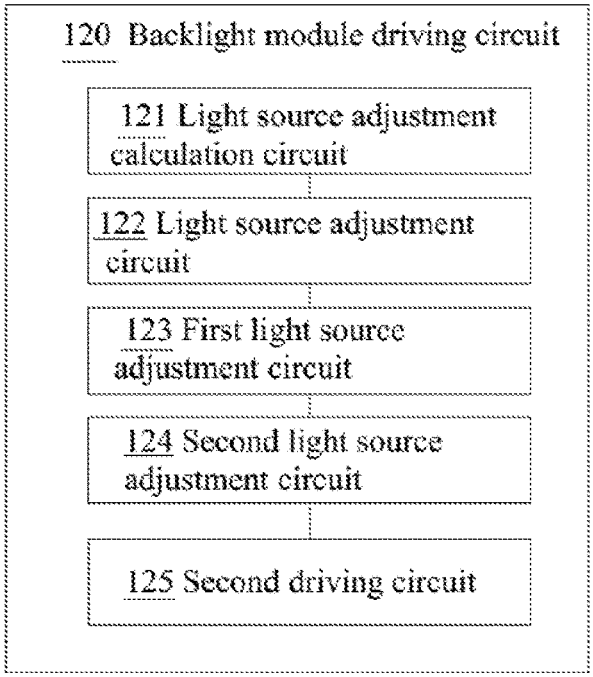
FIG. 13 is a schematic diagram of a driving circuit of a backlight module according to one embodiment of the present disclosure.

FIG. 11 is a schematic diagram of a driving system of a display panel according to one embodiment of the present disclosure. FIG. 12 is a schematic diagram of a driving circuit of a display panel according to one embodiment of the present disclosure. FIG. 13 is a schematic diagram of a driving circuit of a backlight module according to one embodiment of the present disclosure. As shown in FIGS. 11 to 13, and combined with FIGS. 1 to 10, the present disclosure further provides a driving system of a display module 100, on which the above driving method is applied.

The driving system 100 includes a display panel driving circuit 110, and a backlight module driving circuit 120 driven synchronously with the display panel driving circuit 110.

The display module includes a plurality of first color light sources 130, second color light sources 140, and third color light sources 150. The first color light sources 130, the second color light sources 140, and the third color light sources 150 are controlled independently.

The display panel driving circuit 110 includes a color saturation adjustment circuit 111 receiving first color signals corresponding to a display panel and converting the first color signals into second color signals; and a first driving circuit 112 driving the display panel by the second color signals.

The backlight module driving circuit 120 includes:

a light source adjustment calculation circuit 121 receiving the first color signals corresponding to the display panel, obtaining the second color signals, and obtaining a first light source adjustment coefficient and a second light source adjustment coefficient according to the first color signals and the second color signals;

a light source adjustment circuit 122 obtaining a primary hue interval light source and a secondary hue interval light source of the first color light sources, the second color light sources, and the third color light sources by calculating;

a first light source adjustment circuit 123 adjusting a first brightness value corresponding to the primary hue interval light source by the first light source adjustment coefficient to obtain a second brightness value;

a second light source adjustment circuit 124 adjusting a first brightness value corresponding to the secondary hue interval light source by the second light source adjustment coefficient to obtain a third brightness value; and a second driving circuit 125 driving the primary hue light source by the second brightness value and driving the secondary light source by the third brightness value.

Figure 14:
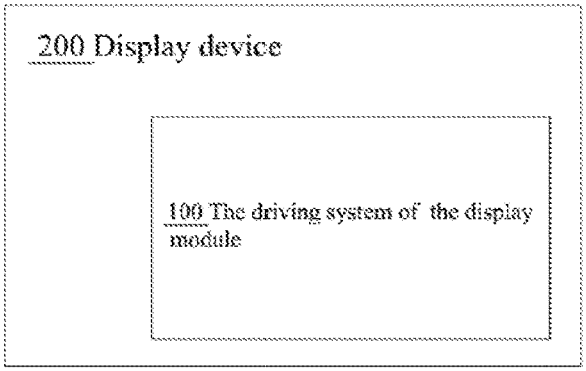
FIG. 14 is a schematic diagram of a display device according to one embodiment of the present disclosure.

FIG. 14 is a schematic diagram of a display device according to one embodiment of the present disclosure. As shown in FIG. 14, and combined with FIGS. 1 to 13, the present disclosure further provides a display device 200, including the driving system of the display module of the present disclosure.

It should be noted that the limitation of each step involved in the present disclosure is not determined to limit the sequence of steps without affecting the implementation of the specific solution. Steps written in the foregoing can be executed first, or later, or even simultaneously as long as the specific solutions can be implemented, which should be considered as the scope of the present disclosure.

The present disclosure is able to be applied on various display panels, such as a twisted-nematic (TN) type display panel, in-plane Switching (IPS) type display panel, a vertical-alignment (VA) type display panel, and Multi-domain Vertical Alignment type display panel. Of course, the display panel can be other types of display panels which is able to be applied.

The technical solution of the present disclosure is able to be widely applied to various display panels, only if it is applicable.

The above content is a further detailed description of the present disclosure in conjunction with the specific optional embodiments, and the specific implementation of the present disclosure is not limited to the description. It will be apparent to those skilled in the art that a number of simple deductions or substitutions may be made without departing from the conception of the present disclosure, which should be considered as being within the scope of the present disclosure.

What is claimed is:

1. A driving method of a display module, comprising a display panel driving process, and a backlight module driving process driven synchronously with the display panel driving process;

wherein the display module comprises a plurality of first color light sources, second color light sources, and third color light sources; the first color light sources, the second color light sources, and the third color light sources controlled independently;

wherein the display panel driving process comprises steps:

receiving first color signals corresponding to a display panel, and converting the first color signals into second color signals; and driving the display panel by the second color signals;

wherein the backlight module driving process comprises steps:

receiving the first color signals corresponding to the display panel, obtaining the second color signals, and obtaining a first light source adjustment coefficient and a second light source adjustment coefficient according to the first color signals and the second color signals;

obtaining a primary hue interval light source and a secondary hue interval light source of the first color light sources, the second color light sources, and the third color light sources by calculating;

adjusting a first brightness value corresponding to the primary hue interval light source by the first light source adjustment coefficient to obtain a second brightness value;

adjusting a first brightness value corresponding to the secondary hue interval light source by the second light source adjustment coefficient to obtain a third brightness value; and driving the primary hue interval light source by the second brightness value and driving the secondary hue interval light source by the third brightness value.

2. The driving method of the display module according to claim 1, wherein the step of receiving the first color signals corresponding to the display panel, obtaining the second color signals, and obtaining the first light source adjustment coefficient and the second light source adjustment coefficient according to the first color signals and the second color signals comprises steps:

obtaining first color space signals and second color space signals of all pixels in current backlight partitions corresponding to a current frame, calculating a first average color saturation signal corresponding to the first color space signals and a second average color saturation signal corresponding to the second color space signals respectively; and obtaining the first light source adjustment coefficient and the second light source adjustment coefficient by calculating the first average color saturation signal and the second average color saturation signal.

3. The driving method of the display module according to claim 1, wherein the first color signals are RGB three primary hue signals in the RGB system, and the first color signals comprises red sub-pixel signals, green sub-pixel signals, and blue sub-pixel signals;

wherein the step of receiving the first color signals corresponding to the display panel, obtaining the second color signals, and obtaining the first light source adjustment coefficient and the second light source adjustment coefficient according to the first color signals and the second color signals comprises steps:

obtaining the first color signals of all pixels in the current backlight partitions corresponding to the current frame, calculating a maximum average signal of the first color signals maxn_ave, a medium average signal of the first color signals mid_nave and a minimum average signal of the first color signals minn_ave among a red sub-pixel average signal of the first color signals, a green sub-pixel average signal of the first color signals, and a blue sub-pixel average signal of the first color signals; and obtaining the first average color saturation signal Sn_ave by calculating the maximum average signal of the first color signals and the minimum average signal of the first color signals, wherein Sn_ave=1−minn_ave/maxn_ave;

calculating a maximum average signal of the second color signals max'n_ave, a medium average signal of the second color signals, and a minimum average signal of the second color signals min'n_ave;

obtaining the second average color saturation signal S'n_ave by calculating the maximum average signal of the second color signals and the minimum average signal of the second color signals, wherein S'n_av=1−min'n_ave/max'n_ave; and calculating the first light source adjustment coefficient y according to the first average color saturation signal and the second average color saturation signal, and the light source adjustment coefficient y satisfies following formulas:

$$Sn_ave=1-min_ave/max_ave=1-min'_ave/(max'_ave*y);\ \text{and}\ y=(min'_ave*max_ave)/(min_ave*max'_ave);\ \text{and}$$

calculating the second light source adjustment coefficient x according to the first light source adjustment coefficient y, and the second light source adjustment coefficient x satisfies following formulas:

$$max_ave/mid_ave=max'_ave*y/mid'_ave*x;\ \text{and}$$

$$x=(min'_ave*mid_ave\,Y(min_ave*mid'_ave).$$

4. The driving method of the display module according to claim 3, wherein the step of calculating the first average color saturation signal Sn_ave comprises steps:

obtaining the first color signals Rn_i, j, Gn_i, j, Bn_i, j, and converting each group of RGB three primary color sub-pixel grayscale signals into three primary color normalized luminance signals r, g, b; and obtain first normalized luminance signals rn_ij, gn_ij, bn_ij after completing the conversion;

calculating a red sub-pixel average signal rn_ave, a green sub-pixel average signal gn-ave, and a blue sub-pixel average signal bn-ave of the first color signals of all pixels in the current backlight partitions corresponding to the current frame;

calculating the maximum average signal of the first color signals maxn-ave, the medium average signal of the first color signals mid_nave, and the minimum average signal of the first color signals minn-ave among three sub-pixel average signals; and obtaining the first average color saturation signal by calculating the maximum average signal of the first color signals and the minimum average signal of the first color signals, and Sn_ave=1−minn_ave/maxn_ave;

wherein r=(R/255)^γr, g=(G/255)^γg, b=(B/255)^γb, and γr, γg, γb are gamma signals of the first color signals;

wherein the R, G, and B refer to RGB three primary color grayscale digital signals corresponding to the first color signals;

wherein the maximum average signal of the first color signals maxn_ave=Max(rn_ave, gn_ave, bn_ave), the medium average signal of the first color signals mid_nave=Mid(rn_ave, gn_ave, bn_ave), and the minimum average signal of the first color signals minn_ave=Min(rn_ave, gn_ave, bn_ave), wherein rn_ave=Average(rn_1,1, rn_1,2, . . . , rn_i,j), gn_ave=Average(gn_1,1, gn_1,2, . . . , gn_i,j), and bn_ave=Average(bn_1,1, bn_1,2, . . . , bn_i,j);

wherein the step of calculating the second average color saturation signal S' n_ave comprises steps:

obtaining the second color signals R'n_i, j, G'n_i, j, B'n_i, j, and converting each group of RGB three primary color sub-pixel grayscale signals into three primary color normalized luminance signals r', g', b'; and obtain the second normalized luminance signals r'n_i,j, g'n_i,j, b'n_i,j after completing the conversion;

calculating a red sub-pixel average signal r'n_ave, a green sub-pixel average signal g'n-ave, and a blue sub-pixel average signal b'n-ave of the second color signals of all pixels in the current backlight partitions corresponding to the current frame;

calculating the maximum average signal of the second color signals maxn-ave, the medium average signal of the second color signals mid_nave, and the minimum average signal of the second color signals minn-ave among three sub-pixel average signals; and obtaining the second average color saturation signal by calculating the maximum average signal of the first color signals and the minimum average signal of the first color signals, and S'n_ave=1−min' n_ave/max-'n_ave;

wherein r'=(R'/255)^γr, g'=(G'/255)^γg, b'=(B'/255)^γb, and γr, γg, γb are gamma signals of the second color signals;

wherein the R', G', and B' refer to RGB three primary color grayscale digital signals corresponding to the second color signals;

wherein the maxim average signal of the second color signals max' n_ave=Max(r'n_ave, g'n_ave, b'n_ave), the medium average signal of the second color signals mid'_nave=Mid(r'n_ave, g'n_ave, b'n_ave), and the minimum average signal of the second color signals min'n_ave=Min(r'n_ave, g'n_ave, b'n_ave), wherein r'n_ave=Average(r'n_1,1, r'n_1,2, . . . , r'n_i,j), g'n_ave=Average(g'n_1,1, g'n_1,2, . . . , g'n_i,j), b'n_ave=Average(b'n_1,1, b'n_1,2, . . . , b'n_i,j).

5. The driving method of the display module according to claim 2, wherein the step of receiving first color signals corresponding to the display panel, and converting the first color signals into the second color signals comprises steps:

receiving the first color signals in an RGB (red, green, blue) system corresponding to the display panel, and converting the first color signals into first color space signals in an HSV (hue, saturation, value) system;

obtaining current color saturation signals of the first color space signals, and obtaining predetermined adjustment coefficients corresponding to the current color saturation signals;

lowering color saturation values of the current color saturation signals by the predetermined adjustment coefficients, completing an adjustment process of the current color saturation signals, and obtaining second color space signals in the HSV system; and converting the second color space signals into second color signals in the RGB system;

wherein the step of obtaining the first light source adjustment coefficient and the second light source adjustment coefficient according to the first color signals and the second color signals comprises steps:

obtaining the first color space signals and the second color space signals of all pixels in current backlight partitions corresponding to the current frame, calculating the first average color saturation signal corresponding to the first color space signals and the second average color saturation signal corresponding to the second color space signals, respectively; and obtaining the first light source adjustment coefficient and the second light source adjustment coefficient by calculating the first average color saturation signal and the second average color saturation signal;

wherein calculating the first light source adjustment coefficient and the second light source adjustment coefficient comprises steps:

calculating the first average color saturation signal corresponding to the first color space signals by using a formula Sn_ave=Average(Sn_1,1, Sn_1,2, . . . , Sn_i,j);

calculating the second average color saturation signal corresponding to the second color space signals by using a formula S'n_ave=Average(S'n_1,1, S'n_1,2, . . . , S'n_i,j); and obtaining the first light source adjustment coefficient and the second light source adjustment coefficient by calculating the first average color saturation signal Sn_ave and the second average color saturation signal S'n_ave.

6. The driving method of the display module according to claim 5, wherein the step of converting the first color signals into the first color space signals in the HSV system comprises steps:

obtaining the first color signals Rn_i, j, Gn_i, j, Bn_i, j, and converting each group of RGB three primary color sub-pixel grayscale signals into three primary color normalized luminance signals r, g, b; and obtain first normalized luminance signals rn_i,j, gn_i,j, bn_i,j after completing the conversion;

converting the first color signals into the first color space signals according to the first normalized luminance signals, and S=1−mini,j/maxi,j;

wherein the step of lowering the color saturation values of the current color saturation signals by the predetermined adjustment coefficients, completing the adjustment process of the current color saturation signals, and obtaining the second color space signals in the HSV system comprises steps:

keeping mini,j unchanged while adjusting mini,j by the predetermined adjustment coefficients;

completing an adjustment of the color saturation signals to obtained the second color space signals in the HSV system S'=1−mini,j*H/maxi,j;

wherein mini,j=min (rn_i,j, gn_i,j, bn_i,j), and maxi,j=max (rn_i,j, gn_i,j, bn_i,j).

7. The driving method of the display module according to claim 6, wherein the step of obtaining the first light source adjustment coefficient and the second light source adjustment coefficient by calculating the first average color saturation signal Sn_ave and the second average color saturation signal S'n_ave comprises steps:

calculating the first average color saturation signal by using a formula Sn_ave=1−minn_ave/maxn_ave;

calculating the second average color saturation signal by using a formula S'n_ave=1−min'n_ave/max'n_ave;

obtaining a third average color saturation signal S"n_ave according to the first light source adjustment coefficient and the second average color saturation signal;

wherein the first light source adjustment coefficient y satisfies the following formulas:

$$S''n_ave = Sn_ave, \text{ and}$$

$$2 - min n_ave / max n_ave = 1 - min' n_ave / (max n_ave * y), \text{ and}$$

$$y = (S'n_ave - 1)/(Sn_ave - 1); \text{ and}$$

calculating the second light source adjustment coefficient x according to the first light source adjustment coefficient y, and the second light source adjustment coefficient x satisfies the following formulas:

$$max n_ave / mid n_ave = max n_ave * y / mid' n_ave * x;$$

$$x = (min' n_ave * mid n_ave)/(min n_ave * mid' n_ave;$$

wherein maxn_ave is the maximum average signal of the first color signals among the red sub-pixel average signal, the green sub-pixel average signal, and the blue sub-pixel average signal of the first color signals of all pixels in the current backlight partitions corresponding to the current frame; midn_ave is the medium average signal of the first color signals among the red sub-pixel average signal, the green sub-pixel average signal, and the blue sub-pixel average signal of the first color signals of all pixels in the current backlight partitions corresponding to the current frame; and minn_ave is the minimum average signal of the first color signals among the red sub-pixel average signal, the green sub-pixel average signal, and the blue sub-pixel average signal of the first color signals of all pixels in the current backlight partitions corresponding to the current frame;

wherein maxn_ave is also the maximum average signal of the second color signals among a red sub-pixel average signal, a green sub-pixel average signal, and a blue sub-pixel average signal of the second color signals of all pixels in the current backlight partitions corresponding to the current frame; mid'n_ave is the medium average signal of the second color signals among the red sub-pixel average signal, the green sub-pixel average signal, and the blue sub-pixel average signal of the first color signals of all pixels in the current backlight partitions corresponding to the current frame; and min'n_ave is the minimum average signal of the second color signals among the red sub-pixel average signal, the green sub-pixel average signal, and the blue sub-pixel average signal of the second color signals of all pixels in the current backlight partitions corresponding to the current frame.

8. The driving method of the display module according to claim 1, wherein the step of adjusting the color saturation of the first color signals to obtain the second color signals comprises steps:

obtaining the first color signals in an RGB system, and converting the first color signals in the RGB system into first color space signals in an HSV system;

obtaining current color saturation signals of the first color space signals, detecting whether the current color saturation signals satisfy a predetermined color saturation threshold, and detecting whether the current color saturation signals are in an adjusted hue interval, and if yes, obtaining corresponding predetermined adjustment coefficients according to the corresponding color saturation values and corresponding hue intervals based on the color saturation signals;

adjusting the current color saturation signals to obtain second color space signals in the HSV system by the predetermined adjustment coefficients; and converting the second color space signals in the HSV system into the second color signals in the RGB system.

9. The driving method of the display module according to claim 8, wherein the predetermined adjustment coefficients are obtained by calculating the color saturation signals according to a predetermined calculation formula or by looking up in a predetermined adjustment coefficient look up table.

10. The driving method of the display module according to claim 9, wherein the adjustment coefficient look up table is a look up table directly recorded with predetermined adjustment coefficients or is a look up table recording a predetermined calculation formula.

11. The driving method of the display module according to claim 10, wherein the second color space signals in the HSV system and the first color space signals in the HSV system conform to the following formula:

$$S'=a*S4+b*S3+c*S2+d*S+e;$$

wherein S is the current color saturation signals corresponding to the first color space signals in the HSV system, and S' is the color saturation signals corresponding to the second color space signals in the HSV system; the a, b, c, d, e are constants, the a, b, c, d, e are obtained by looking up in a predetermined formula coefficient look up table according to different color saturation values and different hue intervals.

12. The driving method of the display module according to claim 8, wherein the color saturation threshold is 0.5, and if the color saturation values of the current color saturation signals are greater than 0.5, the color saturation values of the current color saturation signals satisfy the color saturation threshold.

13. The driving method of the display module according to claim 8, wherein the color saturation threshold is more than 0.5 and less than 1.

14. The driving method of the display module according to claim 8, wherein when corresponding to a same hue, the greater the color saturation values of the current color saturation signals, and the greater an adjustment amplitude of an adjustment process is.

15. The driving method of the display module according to claim 14, wherein the hue interval comprises a red hue interval, a green hue interval, and a blue hue interval;

wherein in the current color saturation signals having a same color saturation value, an adjustment amplitude of the predetermined color adjustment signals corresponding to the blue hue interval to the current color saturation signals is greater than the adjustment amplitude of the predetermined color adjustment signals corresponding to the red hue interval to the current color saturation signals; the adjustment amplitude of the predetermined color adjustment signals corresponding to the red hue interval to the current color saturation signals is greater than the adjustment amplitude of the predetermined color adjustment signals corresponding to the green hue interval to the current color saturation signals.

16. The driving method of the display module according to claim 15, wherein a hue value ranges from 0-360, corresponding to 0-360 degrees;

wherein the hue value of a hue interval satisfying a following formula is the red hue interval: $0 \leq Hue < 40$, or $320 < Hue \leq 360$;

wherein the hue value of the hue interval satisfying a following formula is the green hue interval: $80 < Hue < 160$;

wherein the hue value of the hue interval satisfying a following formula is the blue hue interval: $40 \leq Hue \leq 80$, or $160 \leq Hue \leq 200$;

wherein the hue value of the hue interval satisfying the following formula is an unadjusted hue interval: $40 \leq Hue \leq 80$, or $160 \leq Hue \leq 200$, or $280 \leq Hue \leq 320$.

17. A driving system of a display module; comprising:

a display panel driving circuit, and a backlight module driving circuit driven synchronously with the display panel driving circuit;

wherein the display module comprises a plurality of first color light sources, second color light sources, and third color light sources; the first color light sources, the second color light sources, and the third color light sources controlled independently;

wherein the display panel driving circuit comprises:

a color saturation adjustment circuit receiving first color signals corresponding to a display panel and converting the first color signals into second color signals; and a first driving circuit driving the display panel by the second color signals;

wherein the backlight module driving circuit comprises:

a light source adjustment calculation circuit receiving the first color signals corresponding to the display panel, obtaining the second color signals, and obtaining a first light source adjustment coefficient and a second light source adjustment coefficient according to the first color signals and the second color signals;

a light source adjustment circuit obtaining a primary hue interval light source and a secondary hue interval light source of the first color light sources, the second color light sources, and the third color light sources by calculating;

a first light source adjustment circuit adjusting a first brightness value corresponding to the primary hue interval light source by the first light source adjustment coefficient to obtain a second brightness value;

a second light source adjustment circuit adjusting a first brightness value corresponding to the secondary hue interval light source by the second light source adjustment coefficient to obtain a third brightness value; and a second driving circuit driving the primary hue light source by the second brightness value and driving the secondary light source by the third brightness value.

18. A display device, comprising a driving system of a display module; wherein the driving system comprises:

a display panel driving circuit, and a backlight module driving circuit driven synchronously with the display panel driving circuit;

wherein the display module comprises a plurality of first color light sources, second color light sources, and third color light sources; the first color light sources, the second color light sources, and the third color light sources controlled independently;

wherein the display panel driving circuit comprises:

a color saturation adjustment circuit receiving first color signals corresponding to a display panel and converting the first color signals into second color signals; and a first driving circuit driving the display panel by the second color signals;

wherein the backlight module driving circuit comprises:

a light source adjustment calculation circuit receiving the first color signals corresponding to the display panel, obtaining the second color signals, and obtaining a first light source adjustment coefficient and a second light source adjustment coefficient according to the first color signals and the second color signals;

a light source adjustment circuit obtaining a primary hue interval light source and a secondary hue interval light source of the first color light sources, the second color light sources, and the third color light sources by calculating;

a first light source adjustment circuit adjusting a first brightness value corresponding to the primary hue interval light source by the first light source adjustment coefficient to obtain a second brightness value;

a second light source adjustment circuit adjusting a first brightness value corresponding to the secondary hue interval light source by the second light source adjustment coefficient to obtain a third brightness value; and a second driving circuit driving the primary hue light source by the second brightness value and driving the secondary light source by the third brightness value.

* * * * *